US005675919A

United States Patent [19]

Yao

[11] Patent Number: 5,675,919

[45] Date of Patent: Oct. 14, 1997

[54] IRON WITH STEAM AND DRAIN CONCENTRIC TUBES

[75] Inventor: Isoji Yao, Higashiosaka, Japan

[73] Assignee: Naomoto Industry Co., Ltd., Osaka, Japan

[21] Appl. No.: 722,928

[22] Filed: Sep. 30, 1996

[30] Foreign Application Priority Data

Apr. 5, 1996 [JP] Japan ..... 8-110371

[51] Int. Cl.[6] ..... D06F 75/06

[52] U.S. Cl. ..... 38/77.6; 38/85; 38/77.9

[58] Field of Search ..... 38/3, 14, 77.1, 38/72.6, 77.83, 77.9, 85, 82, 84; 68/5 R, 5 A, 222; 165/DIG. 197, DIG. 199, DIG. 200; 122/492, 489, 508, 511; 417/151; 137/171; 100/73

[56] References Cited

U.S. PATENT DOCUMENTS

| | | | |
|---|---|---|---|
| 1,593,896 | 7/1926 | Brewer | 38/77.6 |
| 2,137,387 | 11/1938 | Chapin | 38/77.6 |
| 2,602,317 | 7/1952 | Moss | 68/222 X |
| 2,815,593 | 12/1957 | Reimers et al. | 38/77.6 |
| 2,851,050 | 9/1958 | Cissell et al. | 38/77.6 X |
| 3,414,993 | 12/1968 | Naomoto | 38/77.6 |
| 4,987,918 | 1/1991 | Barnadas | 137/171 |

*Primary Examiner*—Ismael Izaguirre

*Attorney, Agent, or Firm*—Armstrong, Westerman, Hattori, McLeland & Naughton

[57] ABSTRACT

A flexible drain tube for exhausting drains from an iron main body is inserted into a flexible steam tube for sending steam into the iron main body in order to form one flexible connection tube. The flexible steam tube of the flexible connection tube connects a fixed steam pipe and a steam chest of the iron main body, and the flexible drain tube of the flexible connection tube connects a fixed drain pipe and the steam chest of the iron main body.

6 Claims, 6 Drawing Sheets

IRON WITH STEAM AND DRAIN CONCENTRIC TUBES

BACKGROUND OF THE INVENTION

1. Field of the Invention

This invention relates to an iron.

2. Description of the Related Art

A conventional iron for business use is, as shown in FIG. 6, connected with a steam supplying tube 43 for sending steam 45 from a steam pipe 41 into an iron main body 40 and a drain discharging tube 44 for discharging drains (waterdrops) 46 collecting inside the iron main body 40 into a drain pipe 42.

However, the two tubes (i.e. the steam supplying tube 43 and the drain discharging tube 44) connected with the iron main body 40 obstruct handling the iron main body 40 and disturb movement of the worker, and this causes inconvenience in using the conventional iron.

It is therefore an object of the present invention to provide an iron for business use wherein the iron is easy to handle and working ability of ironing is improved.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
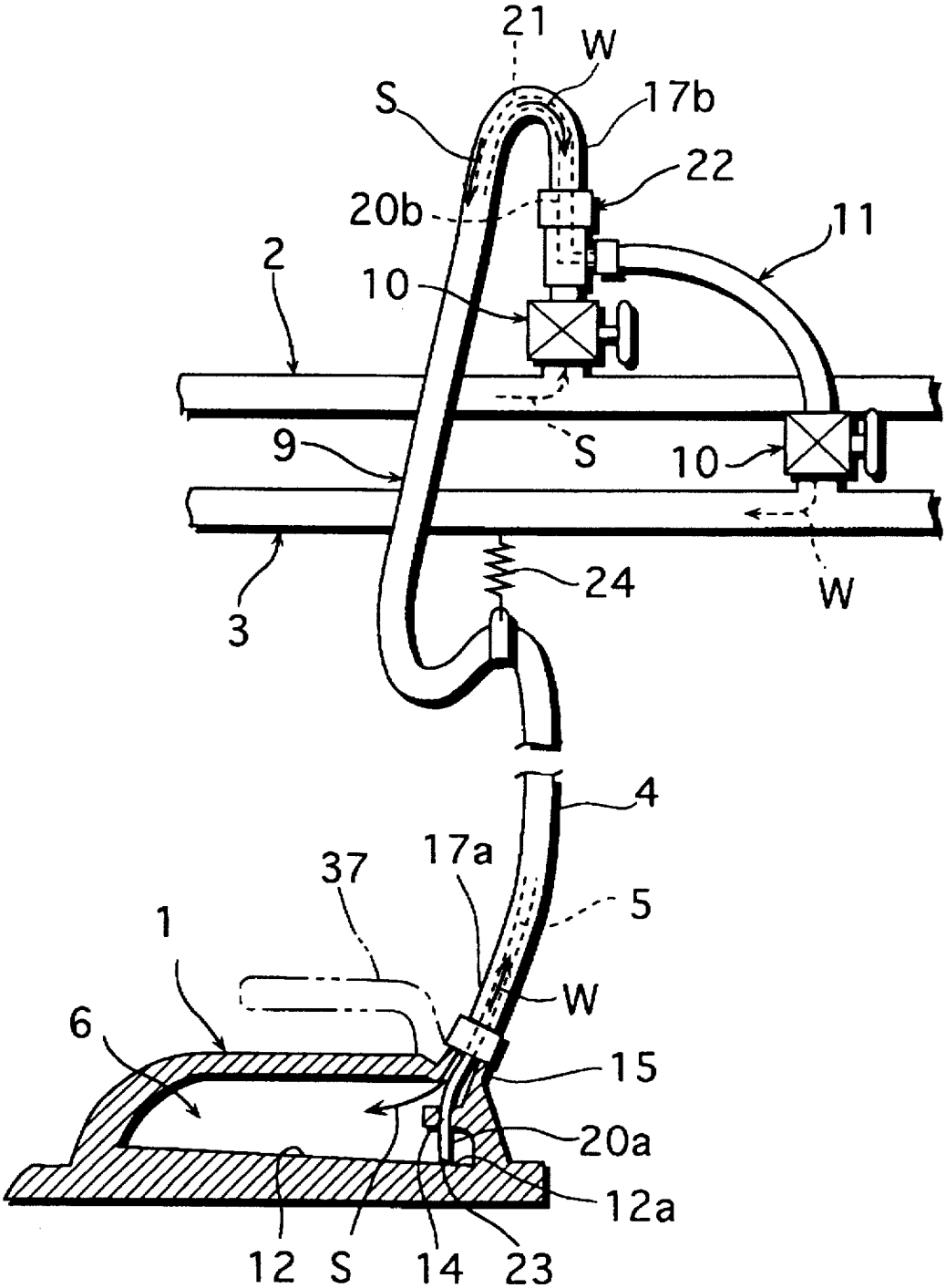
FIG. 1 is a schematic explanatory view of an iron for business use according to the present invention.

FIG. 1 is a schematic explanatory view showing an embodiment of an iron for business use according to the present invention. This iron is a steam iron without an electric heater and is provided with an iron main body 1 having a steam chest 6 inside thereof and a flexible steam tube 4 for sending steam S from a steam pipe 2 connected with a steam generator such as a boiler (not shown in the drawings) to the steam chest 6 of the iron main body 1, and a flexible drain tube 5 for sending (exhausting) drains (waterdrops) W collecting in the steam chest 6 is inserted into the flexible steam tube 4.

A flexible connection tube 9 is formed by inserting the drain tube 5 into the steam tube 4. The steam pipe 2 and a drain pipe 3 fixed at the workshop are connected with the iron main body 1 through this flexible connection tube 9. The flexible steam tube 4 connects the steam pipe 2 and the steam chest 6 of the iron main body 1, and the drain tube 5 connects the drain pipe 3 and the steam chest 6 of the iron main body 1. The flexible connection tube 9 is hung from the ceiling (the drain pipe 3 in the illustration) through an elastic hanging member 24.

Figure 2:
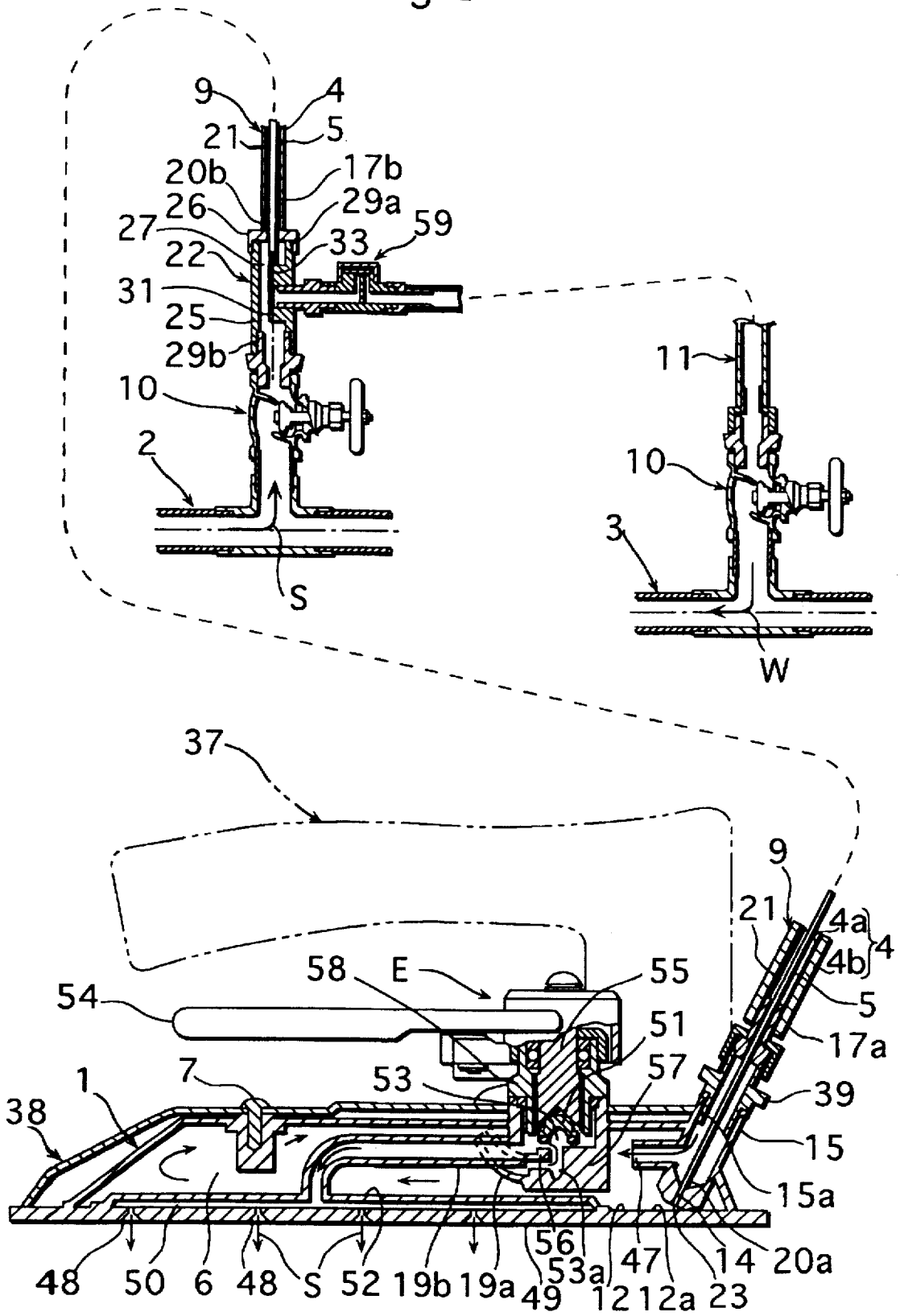
FIG. 2 is a fragmentary sectional view of the iron for business use.

As shown in FIG. 2, this iron is provided with the iron main body 1, an iron cover 38 attached to the iron main body 1 through a screw 7 or a machine screw, a grip portion 37, and a valve opening and shutting mechanism E for ejecting and halting steam from the iron main body 1.

A cylindrical coupling protrusion 15 having a female screw 15*a* is arranged at a rear portion of the iron main body 1. The female screw 15*a* of the coupling protrusion 15 fits with a male screw of the endmost joint member 39 (among a plurality of joint members) connected to an end 17*a* of the flexible connection tube 9 (the flexible steam tube 4).

A steam outlet 47 opening toward the steam chest 6 and a supporting hole portion 14 in which an end 20*a* of the flexible drain tube 5 of the flexible connection tube 9 is held are arranged at a bottom portion of the coupling protrusion 15. An opening end of the flexible drain tube 5, i.e. a drain sucking mouth 23, is arranged (opened) near a rear portion 12*a* of an inner bottom face 12 of the iron main body 1. It is also preferable to incline the inner bottom face 12 so that the rear portion 12*a* becomes lower.

The steam chest 6 and a sub-room 50, which is placed along a bottom wall 49 and isolated from the steam chest 6 by an isolation wall 52, are arranged inside the iron main body 1, and the sub-room 50 communicates with a plurality of steam jets 48 which penetrate the bottom wall 49. The sub-room 50 communicates with the steam chest 6 through a pipe 19*b* connected to the sub-room 50 and a pipe 19*a* connected to the pipe 19*b*, and a passage 53 is arranged between the pipe 19*a* and the pipe 19*b* and is provided with a valve 51 of the valve opening and shutting mechanism E.

This passage 53 is arranged by forming a depression, which inner face possesses a female screw, on a block wall 57 arranged on the iron main body 1, fitting a cylindrical barrel portion 58, where an axis 55 of the valve opening and shutting mechanism E is inserted, into the depression, and forming a space on the block wall 57. The pipe 19*a* and the pipe 19*b* are attached to the block wall 57, and the passage 53 communicates with the steam chest 6 through the pipe 19*a* and a small depression portion 53*a* arranged on a bottom face of the depression.

The valve opening and shutting mechanism E functions as follows. When a handle portion 54 which is arranged to pivot on the axis 55 is swung manually, for example, the valve 51 ascends along with the axis 55 due to elasticity of an elastic member (a spring) (not shown in the attached drawings) placed in the small depression portion 53*a* at the bottom of the passage 53. When the handle portion 54 is released, the handle portion 54 returns to the former place owing to another elastic member (not shown in the attached drawings), and the axis 55 pushes the valve 51 downward.

A bottom wall of the block wall 57 functions as a valve seat 56 for the valve 51, and when the handle portion 54 is released, the valve 51 sticks to the valve seat 56, and the small depression portion 53*a* is covered and the valve is shut. That is to say, the pipe 19*a* and the pipe 19*b* are intercepted. The valve opens by oscillating the handle portion 54, and the pipe 19*a* and the pipe 19*b* communicate as illustrated.

As shown in FIG. 1 and FIG. 2, the flexible steam tube 4 comprises, for example, a tube main body 4*a* and a braided tube 4*b* for reinforcement which covers the tube main body 4*a*. An end 17*a* of the flexible steam tube 4 is connected with a mouth portion of the coupling protrusion 15 through, for example, one of the joint members 39. The other end 17*b* is connected with the steam pipe 2, which is for sending steam from a steam generator not shown in the attached drawings, through a joint member 22 and a valve 10 as described below in detail. The tube main body 4*a* is formed of plastic such as fluorine-contained resin.

The flexible drain tube 5 is arranged to have an outer diameter which is smaller than an inner diameter of the flexible steam tube 4. The flexible connection tube 9 is formed by inserting the flexible drain tube 5 into the flexible steam tube 4, and a clearance formed between an inner circumferential face of the steam tube 4 and an outer circumferential face of the drain tube 5 functions as a steam passage 21. The flexible drain tube 5 is made of plastic such as fluorine-contained resin.

The end 20*a* of the flexible drain tube 5 is, as described in the foregoing, kept close to the rear portion 12*a* of the inner bottom face 12 of the iron main body 1, and the other end 20*b* is connected with the joint member 22. The flexible drain tube 5 connected with the joint member 22 communicates with the drain tube 3 through a joint 59 connected with the joint member 22, a relay tube 11, and the valve 10.

Figure 3:
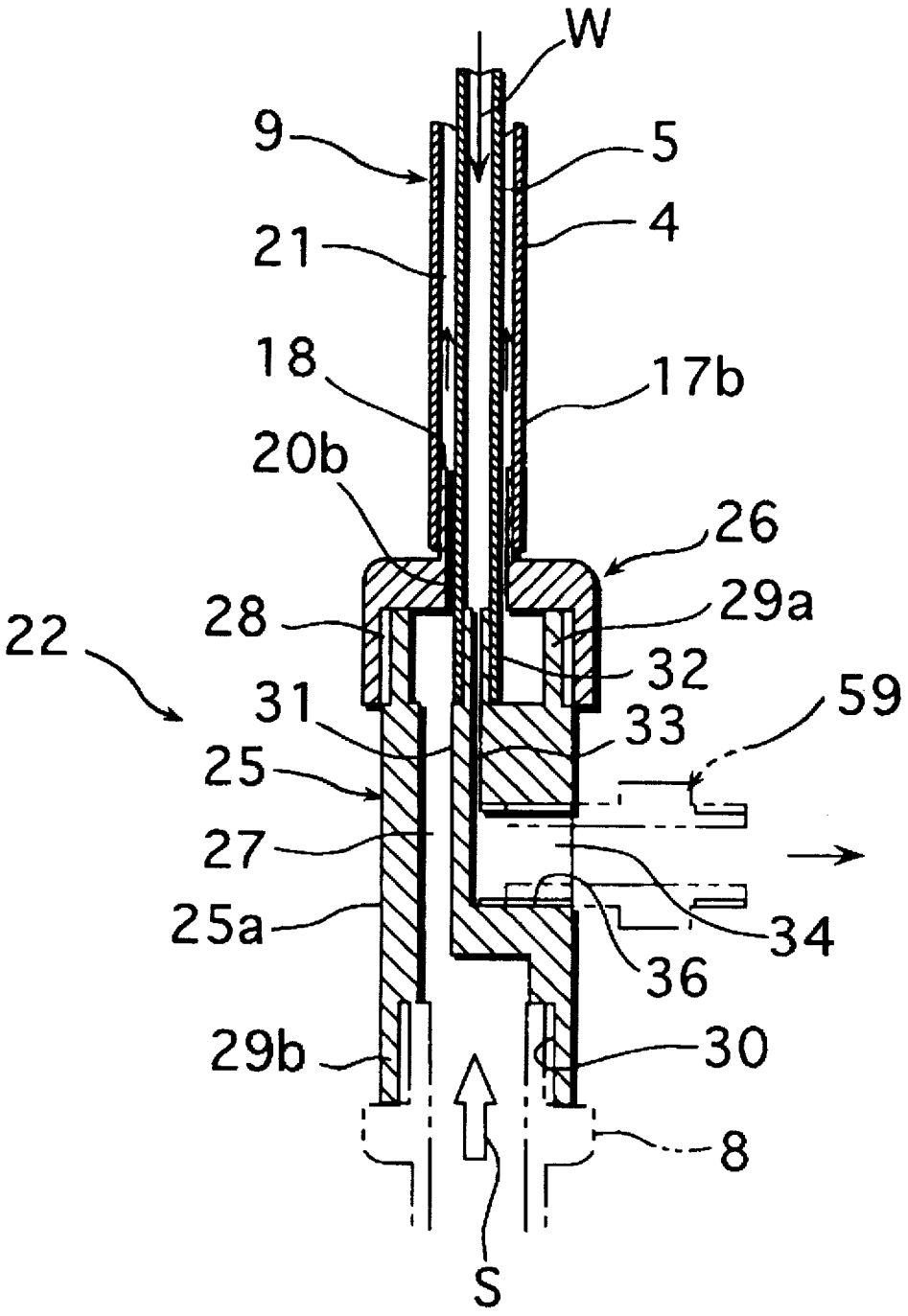
FIG. 3 is a sectional side elevation of a joint member.

As shown in FIG. 3, the joint member 22 is provided with a cylindrical joint main body 25 and a nut member 26 screwing and fitting on the joint main body 25. A cylindrical portion 18 is arranged on the nut member 26, and a mouth end portion of the flexible steam tube 4 of the flexible connection tube 9 is fixed on the cylindrical portion 18.

A male screw 28 which fits with a female screw of the nut member 26 is arranged on an outer circumferential face of an end portion 29*a* of a circumferential wall 25*a* of the joint main body 25, a female screw 30 which fits with a male screw of a joint 8 connected with the valve 10 is arranged on an inner circumferential face of a base end portion 29*b* of the circumferential wall 25*a*, and a steam passage 27 is arranged inside the joint main body 25 in the longitudinal direction.

The circumferential wall 25*a* is provided with a thick wall portion 31 in the middle, and the thick wall portion 31 is provided with a small cylindrical portion 32 which protrudes toward the end side. Moreover, the circumferential wall 25*a* is provided with a drain passage 33 which penetrates the thick wall portion 31 and the small cylindrical portion 32 and passes the axis of the joint main body 25. A female screw 36 is arranged at a mouth portion 34 of the outer circumferential face side of the drain passage 33, and a male screw of the joint 59 joining the relay tube 11 and the joint main body 25 screws and fits in the female screw 36.

The iron of the present invention is for business use (to be used at a factory for sewing men's clothing or women's clothing or at a laundry). The iron for business use according to the present invention is used as explained below with reference to FIG. 2. Steam S sent from the steam generator through the steam pipe 2 passes the steam passage 27 of the joint member 22, passes the steam passage 21 of the flexible connection tube 9, and is fed through the steam outlet 47 in the iron main body 1 into the steam chest 6. At this time, the handle portion 54 of the valve opening and shutting mechanism E is released, therefore the valve 51 adheres to the valve seat 56 and is shut (this situation is not shown in the attached drawings), and the steam S fills the steam chest 6.

When the handle portion 54 is swung, the valve 51 is separated from the valve seat 56 and is opened, and the steam S which fills the steam chest 6 passes from the pipe 19*a* through the passage 53, the small depression portion 53*a*, the pipe 19*b* and into the sub-room 50. The steam S is ejected outside from a plurality of steam jets 48 connected with the sub-room 50.

The steam S filling the steam chest 6 keeps the sub-room 50 warm, therefore the steam S ejected from the steam jets 48 is hot. Moreover, a void space between the iron cover 38 and the iron main body 1 functions as a heat insulating layer and prevents the steam S inside the steam chest 6 to grow cold.

After an article of clothing is ironed, ejection of steam is halted by releasing the handle portion 54, and then, another article of clothing is ironed in the same way. When articles of clothing are ironed one by one as described above, drains W (see FIG. 1) are generated and are collected at the rear portion 12*a* of the inner bottom face 12. The collected drains W are sucked from the drain sucking mouth 23 of the flexible drain tube 5 close to said rear portion 12*a* into the drain tube 5, fed through the joint member 22 and the relay tube 11 toward the drain pipe 3, and sent into a drain sucking pump (not shown in the attached drawings).

Figure 4:
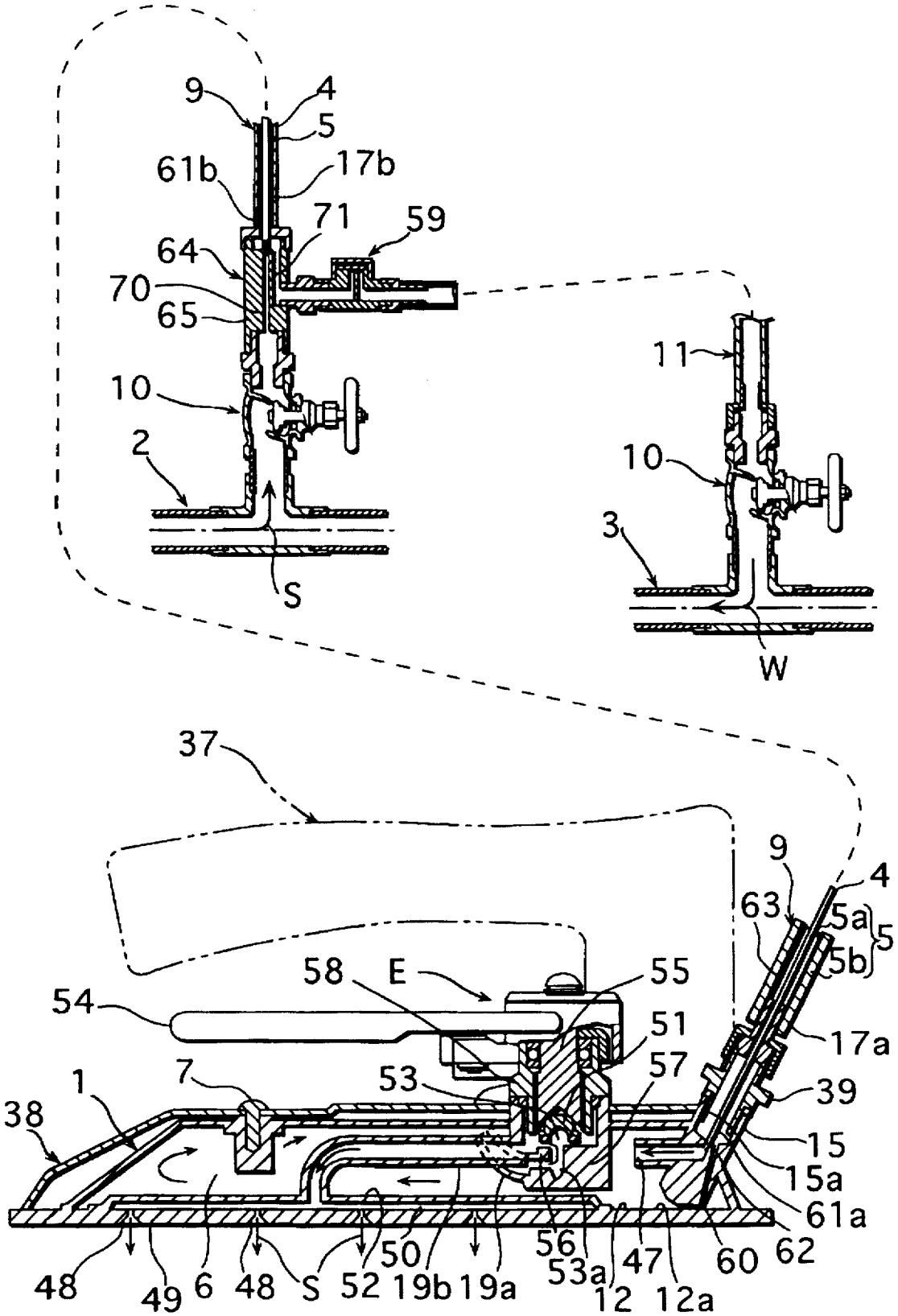
FIG. 4 is a fragmentary sectional view of another iron for business use.

Next, FIG. 4 shows another embodiment, wherein a flexible steam tube 4 for sending steam S into an iron main body 1 is inserted into a flexible drain tube 5 for sending drains W from the iron main body 1 to form one flexible connection tube 9 which joins a steam pipe 2, a drain pipe 3, and the iron main body 1.

In the concrete, as shown in FIG. 4, this iron is provided with the iron main body 1, an iron cover 38 attached to the iron main body 1, a grip portion 37, and a valve opening and shutting mechanism E for ejecting and halting steam from the iron main body 1.

A coupling protrusion 15 in a cylindrical configuration having a female screw 15*a* is attached to a rear portion of the iron main body 1, and a male screw of a joint member 39 connected to an end 17*a* of the flexible connection tube 9 (the flexible drain tube 5) screws and fits in the female screw 15*a* of the coupling protrusion 15.

A bottom portion of the coupling protrusion 15 is provided with a steam outlet 47 which is connected with the coupling protrusion 15 and opens toward a steam chest 6 and a drain sucking mouth 60 which is connected with the coupling protrusion 15 and opens near a rear portion 12*a* of an inner bottom face 12 of the iron main body 1. An end 61*a* of the flexible steam tube 4 of the flexible connection tube 9 is inserted and held in a supporting hole portion 62 inside the coupling protrusion 15, and is connected to the steam outlet 47.

The other portion of the iron main body 1 and the valve opening and shutting mechanism E are constructed as described in the explanation of FIG. 2.

As shown in FIG. 4, the flexible drain tube 5 comprises, for example, a tube main body 5*a* and a braided tube 5*b* (for reinforcement) which covers the tube main body 5*a*, and an end 17*a* of the flexible drain tube 5 is connected to a mouth portion of the coupling protrusion 15 through the joint member 39. The other end 1Tb of the flexible drain tube 5 is joined to a joint member 64, and is connected to the drain pipe 3 through a joint 59, a relay tube 11, and a valve 10. The flexible drain tube 5 is made of plastic such as fluorine-contained resin.

The flexible steam tube 4 is arranged to have an outer diameter which is smaller than an inner diameter of the flexible drain tube 5. The flexible steam tube 4 is inserted into the flexible drain tube 5 and they are joined to be one flexible connection tube 9, wherein a space between an outer circumferential face of the steam tube 4 and an inner circumferential face of the drain tube 5 functions as a drain passage 63. The flexible steam tube 4 is made of plastic such as fluorine-contained resin.

As described in the foregoing, the end 61*a* of the flexible steam tube 4 is inserted and held in the supporting hole portion 62 inside the coupling protrusion 15 of the iron main body 1, and the other end 61*b* is connected to the joint member 64.

Figure 5:
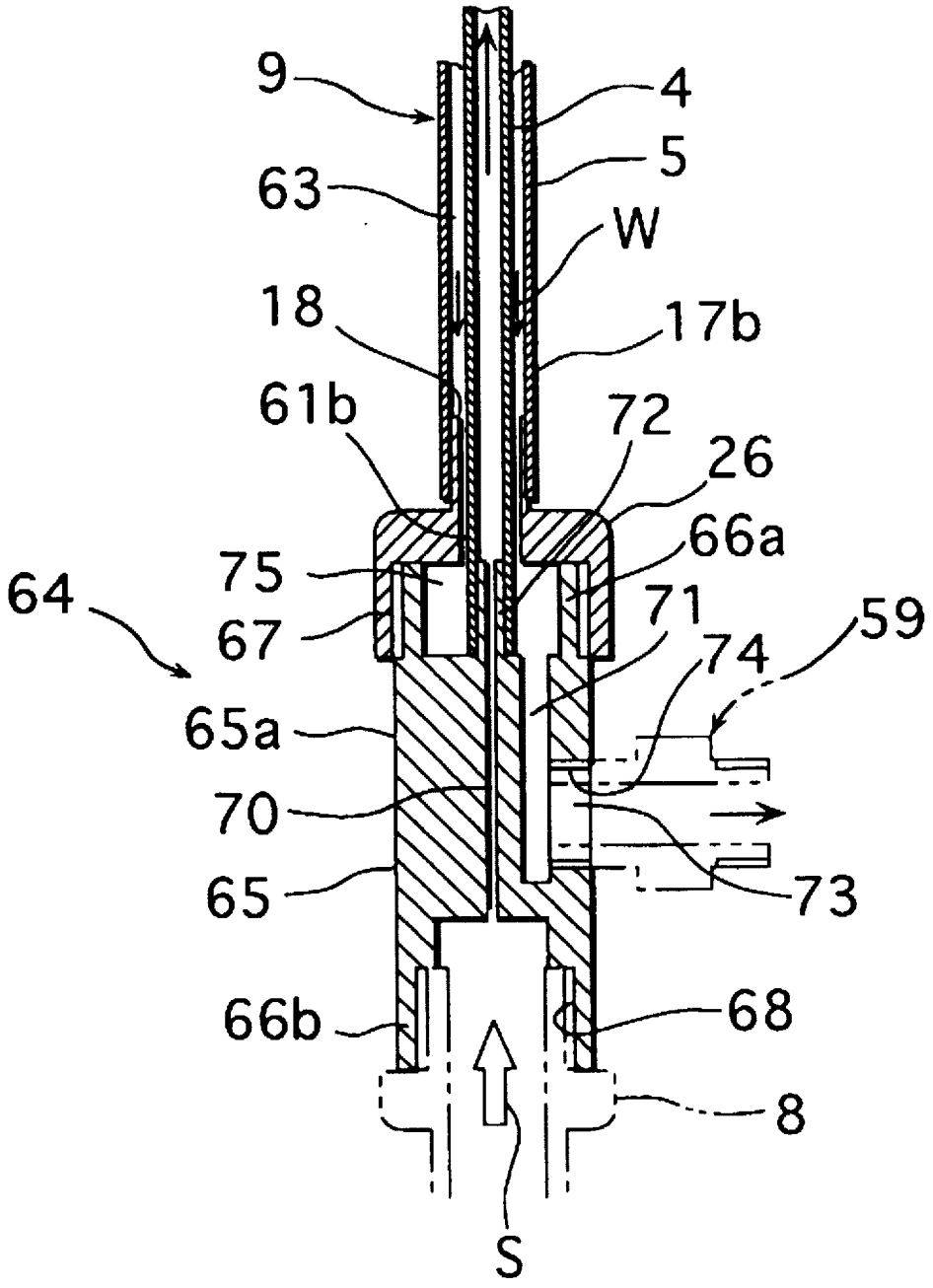
FIG. 5 is a sectional side elevation of another joint member.
Figure 6:
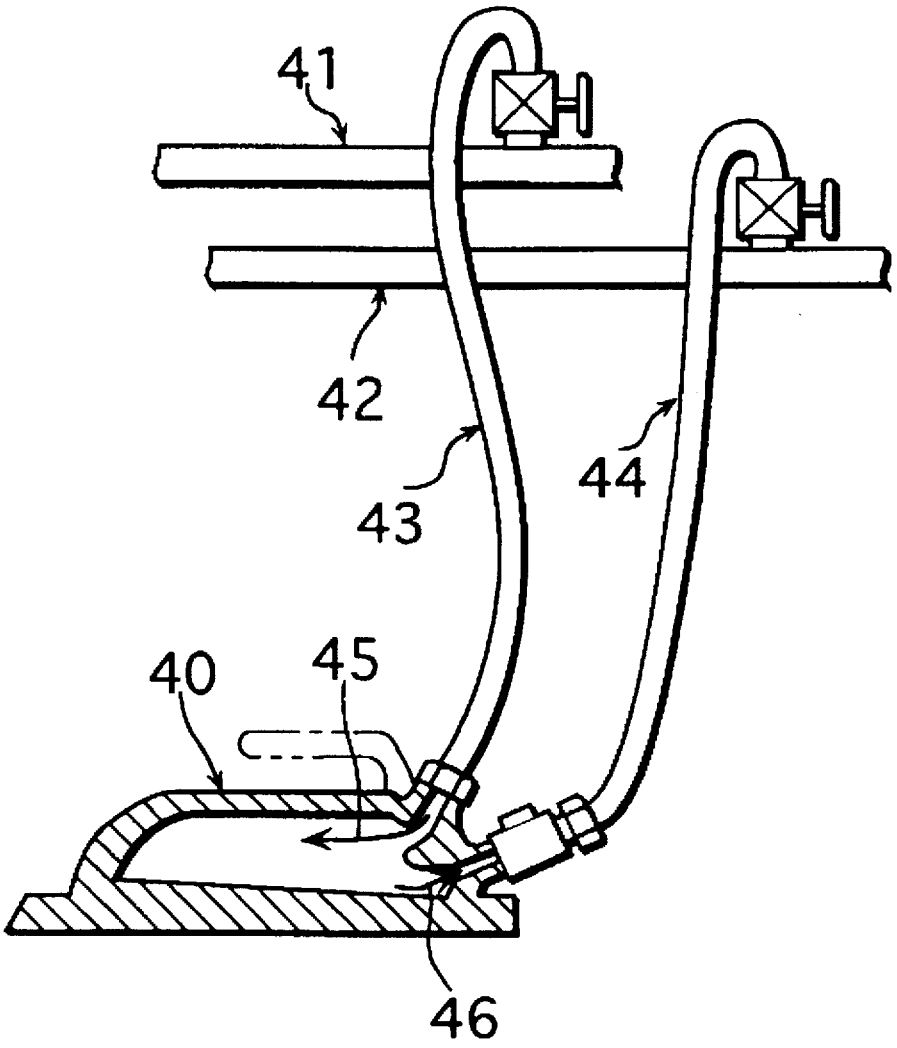
Fig. 6 PRIOR ART
FIG. 6 is a schematic explanatory view showing a conventional iron for business use.

As shown in FIG. 5, the joint member 64 is provided with a hollow joint main body 65 and a nut member 26 which fits with the joint main body 65, and an opening end portion of the flexible drain tube 5 of the flexible connection tube 9 fixedly caps a cylindrical portion 18 of the nut member 26.

The joint main body 65 possesses a male screw 67, which fits with a female screw of the nut member 26, on an outer circumferential face of an end portion 66*a* of a circumferential wall 65*a* of the joint main body 65 and a female screw 68, which fits with a male screw of a joint 8 connected with the valve 10, on an inner circumferential face of a base end portion 66*b* of the circumferential wall 65*a*.

The joint main body 65 also possesses a steam passage 70 at an axis of the circumferential wall 65*a* and a drain passage 71 which penetrates from the outer circumferential face to the end of the circumferential wall 65*a*. A circular opening portion 75 is formed at the end side of the drain passage 71. A small cylindrical portion 72 to be inserted into the other end 61*b* of the flexible steam tube 4 of the flexible connection tube 9 is arranged at an end of the steam passage 70 and a female screw 74 is arranged at a mouth portion 73 of the outer circumferential face side of the drain passage 71, and the female screw 74 fits with a male screw of the joint 59 which connects the relay tube 11 and the joint main body 65.

As shown in FIG. 4, steam S sent from a steam generator through the steam pipe 2 passes the steam passage 70 of the joint member 64 and the flexible steam tube 4 of the flexible connection tube 9, and is sent from a steam outlet 47 inside the iron main body 1 into the steam chest 6. At this moment, the handle portion 54 of the valve opening and shutting mechanism E is released, therefore, the valve 51 adheres to the valve seat 56 and is shut, and the steam S fills the steam chest 6.

When the handle portion 54 is swung, the valve 51 is opened as illustrated, and the steam S which fills the steam chest 6 passes the pipe 19*a*, the passage 53, the small depression portion 53*a*, and the pipe 19*b* and is sent to the sub-room 50. The steam S is ejected outside from the steam jets 48 connected with the sub-room 50.

Drains W in the steam chest 6 are collected at a rear portion 12*a* of the inner bottom face 12, sucked from the drain sucking mouth 60 close to said rear portion 12*a* into the drain passage 63 of the flexible connection tube 9, and are sent through the joint member 64 and the relay tube 11 into the drain pipe 3.

According to the present invention, it is possible to send steam S and discharge drains (waterdrops) W through one tube by using the flexible connection tube 9. It is therefore possible to iron swiftly preventing the tube to disturb movement of the worker and improve working ability.

While preferred embodiments of the present invention have been described in this specification, it is to be understood that the invention is illustrative and not restrictive, because various change's are possible within the spirit and indispensable features.

For example, it is possible to connect the flexible connection tube 9 to a steam iron with a built-in electric heater instead of the steam iron without an electric heater described in the foregoing explanation. If the joint member 22 shown in FIG. 3 is connected with the valve 10 at the drain pipe 3 side and a so connected with the steam pipe 2 through the relay tube 11, it is possible to connect the other end of the flexible connection tube 9, which is formed by inserting the steam tube 4 into the drain tube 5, to the joint member 22. Moreover, if the joint member 64 shown in FIG. 5 is connected to the valve 10 at the drain pipe 3 side, it is possible to connect the other end 17*b* of the flexible connection tube 9, which is formed by inserting the drain tube 5 into the steam tube 4, to the joint member 64.

What is claimed is:

1. An iron wherein a flexible drain tube for exhausting drains from an iron main body is inserted in an inner portion of a flexible steam tube for sending steam into the iron main body in order to form one flexible connection tube, and the flexible steam tube of the flexible connection tube connects a fixed steam pipe and a steam chest of said iron main body, and the flexible drain tube of the flexible connection tube connects a fixed drain pipe and the steam chest of said iron main body.

2. The iron as set forth in claim 1, wherein the flexible drain tube is provided with a drain sucking mouth which is arranged to open near an inner bottom face of the steam chest of the iron main body.

3. An iron wherein a flexible steam tube for sending steam into an iron main body is inserted in an inner portion of a flexible drain tube for exhausting drains from the iron main body in order to form one flexible connection tube, and the flexible steam tube of the flexible connection tube connects a fixed steam pipe and a steam chest of said iron main body, and the flexible drain tube of the flexible connection tube connects a fixed drain pipe and the steam chest of said iron main body.

4. The iron as set forth in claim 3, wherein the flexible drain tube is connected with a drain sucking mouth which is arranged to open near an inner bottom face of the steam chest of the iron main body.

5. The iron as set forth in claim 1 or claim 3, wherein the steam chest and a sub-room which is placed along a bottom wall of the iron main body are arranged inside the iron main body, the steam chest and the sub-room are connected, and a steam jet connected to said sub-room is arranged on said bottom wall.

6. The iron as set forth in claim 5, wherein the iron is provided with a valve opening and shutting mechanism for ejecting and halting steam toward the sub-room operated through a handle portion attached to the iron main body.

* * * * *